US005465141A

United States Patent [19]

Asano et al.

[11] Patent Number: 5,465,141

[45] Date of Patent: Nov. 7, 1995

[54] FIXING APPARATUS FOR CHANGING THE DUTY CYCLE OF ELECTRIC CURRENT SUPPLY

[75] Inventors: Naoki Asano; Yutaka Kikuchi, both of Kawasaki; Yasuyoshi Hayakawa, Yokohama, all of Japan

[73] Assignee: Canon Kabushiki Kaisha, Tokyo, Japan

[21] Appl. No.: 865,242

[22] Filed: Apr. 8, 1992

[30] Foreign Application Priority Data

Apr. 22, 1991 [JP] Japan ..... 3-116643

[51] Int. Cl.[6] ..... G03G 15/20

[52] U.S. Cl. ..... 355/285; 219/216; 355/208

[58] Field of Search ..... 355/285, 282, 355/290, 208; 219/216, 469–471; 236/1 R

[56] References Cited

U.S. PATENT DOCUMENTS

| | | | |
|---|---|---|---|
| 3,398,259 | 8/1968 | Tregay et al. | 355/282 X |
| 4,270,693 | 6/1981 | Hayes | 236/1 R X |
| 4,905,051 | 2/1990 | Satoh et al. | 355/282 X |
| 4,963,943 | 10/1990 | Tamary | 355/285 X |

FOREIGN PATENT DOCUMENTS

| | | |
|---|---|---|
| 0073324 | 3/1983 | European Pat. Off. . |
| 0085950 | 8/1983 | European Pat. Off. . |
| 0301544 | 2/1989 | European Pat. Off. . |

OTHER PUBLICATIONS

Patent Abstracts of Japan, vol. 8, No. 60, Mar. 22, 1984, English Abstract of Japanese Patent No. 58–209771.

Patent Abstracts of Japan, vol. 14, No. 487, Oct. 23, 1990, English Abstract of Japanese Patent No. 2–197908.

Patent Abstracts of Japan, vol. 8, No. 45, Feb. 28, 1984, English Abstract of Japanese Patent No. 58–197524.

*Primary Examiner*—A. T. Grimley

*Assistant Examiner*—Shuk Y. Lee

*Attorney, Agent, or Firm*—Fitzpatrick, Cella, Harper & Scinto

[57] ABSTRACT

A fixing apparatus having a heating member maintained at a predetermined fixing temperature and an electric supply device for supplying an electric current to the heating member, wherein the electric supply device supplies an electric current at a second duty cycle larger than a first duty cycle after an electric current is supplied at the first duty cycle from the time the supply of the electric current is started to the heating member until a fixing temperature is reached.

7 Claims, 8 Drawing Sheets

FIXING APPARATUS FOR CHANGING THE DUTY CYCLE OF ELECTRIC CURRENT SUPPLY

BACKGROUND OF THE INVENTION

1. Field of the Invention

The present invention relates to a fixing apparatus for heating and fixing an unfixed image on a recording member, which apparatus is used in an image forming apparatus, such as a copier or printer.

2. Description of the Related Art

In an image forming apparatus using an electrophotographic process, electrostatic recording process or the like, an image formed on a recording member is heated and fixed. A fixing apparatus used in such image forming apparatus uses a heating member which is kept at a predetermined fixing temperature, as is typically done in a heat roller method.

When the temperature of this heating member is increased to a fixing temperature, even if the supply of electric current to the heating member is stopped at the fixing temperature, the temperature continues to increase beyond the fixing temperature due to an inertia of temperature increase, i.e., a so-called overshoot, occurs. Thus, electric current being supplied is stopped at a temperature detected by a temperature detection member lower than the fixing temperature to allow for an overshoot amount, so that the temperature is kept constant.

Changes in temperature in a case where such control is performed are shown in FIG. 8. Concerning the temperature graph of FIG. 8, a temperature detection member for detecting the temperature of the surface of a heat roller is disposed outside a recording member transport area.

Reference letter a denotes the roller temperature while the fixing apparatus is in a stand-by mode. The supply of electric current is started or stopped at a temperature b' which is lower than the predetermined temperature b of a temperature detection section so that the above control of the temperature is performed.

Since the temperature in the central portion of the heat roller is highest, while it is lower towards both end portions thereof, the gradient of temperature increase during heating is greatest at the central portion and is lowest at the periphery of a portion where the temperature is detected by a thermistor. Therefore, the $\Delta T$ exceeding the prescribed temperature C of the temperature in the central portion is larger than the $\Delta T$ exceeding the prescribed temperature b of the temperature of the portions where the temperature is detected. As a result, even if the temperature control is switched at a temperature b' as shown and the overshoot is suppressed in the thermistor section, it is difficult to make the $\Delta T$ zero for the central portion of the heat roller. If, on the contrary, such control is performed so that the $\Delta T$ becomes zero for the central portion of the heat roller, a problem arises in that the temperature of the roller decreases near its end portions of the roller.

If the overshoot amount $\Delta T$ is large, the image fixing temperature of a first sheet becomes high, and a high-temperature offset arises during the initial period of the fixing, particularly when the first image is being fixed. For this reason, it is desirable to suppress the $\Delta T$ so that it is as small as possible.

Therefore, it has been suggested to decrease the supplying of electric current to the heat roller as the temperature becomes high so that the temperature increase gradient is lessened. Although in this method the temperature increase gradient is lessened and the overshoot amount $\Delta T$ is decreased, thereby reducing the influence of high temperatures upon the image, the heat roller takes a longer time to reach the fixing temperature b by the lessened gradient of the temperature increase.

SUMMARY OF THE INVENTION

An object of the present invention is to provide a fixing apparatus which decreases overshoot without increasing the time required to reach a fixing temperature.

Another object of the present invention is to provide a fixing apparatus comprising a heating member which is kept at a predetermined fixing temperature and an electric-current supply means for supplying an electric current to the heating member, said electric-current supply means supplying an electric current at a second duty cycle larger than a first duty cycle after the electric supply means supplies an electric current at the first duty cycle from the time the supply of an electric current to the heating member is started until a fixing temperature is reached.

The aforementioned and other objects, features and advantages of the present invention Will become clear when reference is made to the following description of the preferred embodiments of the present invention, together with reference to the accompanying drawings.

DESCRIPTION OF THE PREFERRED EMBODIMENTS

Preferred embodiments of the present invention will be explained below.

Figure 5:
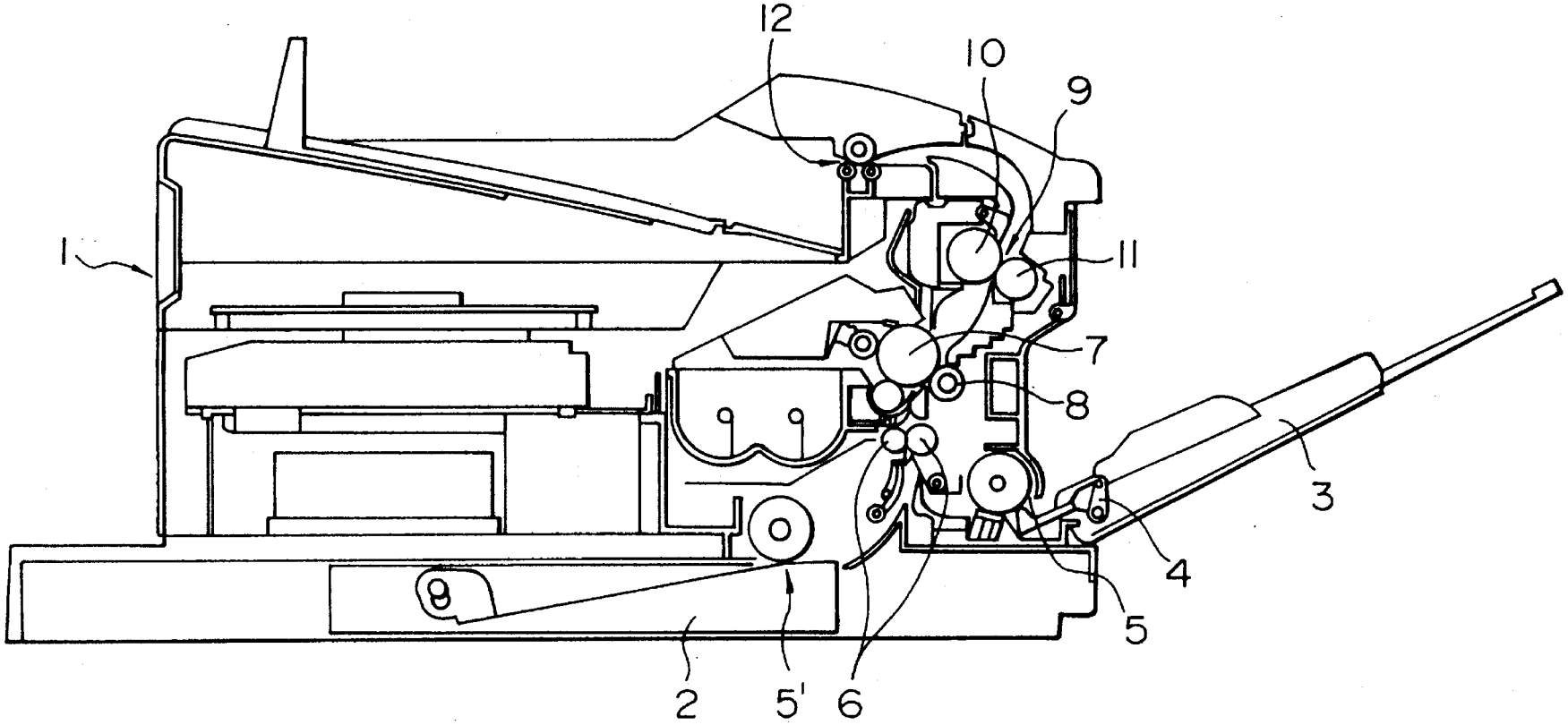
FIG. 5 is a partial cross-sectional view illustrating the schematic construction of an image forming apparatus using the fixing apparatus of this embodiment.

FIG. 5 is a cross-sectional view of an image forming apparatus, based on the laser exposure system, employing a fixing apparatus of an embodiment of the present invention. In FIG. 5, reference numeral 1 denotes a fixing apparatus main body, below which a sheet holding apparatus 2 is set. Sheets on which an image is to be formed are loaded inside the sheet holding apparatus 2, or are fed by what is commonly called a "hand feed" section 3 in which desired sheets can be loaded. The hand feed section 3 can be opened/closed with respect to the apparatus main body, by a hinge 4. The hand feed section 3 is open when in use and closed when not in use. Thus, the hand feed section 3 does not get in the way when not in use.

Sheets (not shown) loaded in the hand feed section 3 or the sheet holding apparatus 2 are separated one by one and fed by paper feed sections 5 and 5', irrespectively The sheets fed are sent to an image carrier 7 and a transfer roller 8 which is pressed against the image carrier 7 after passing registering rollers 6. An image is transferred to the sheet and the sheet is sent to a fixing section 9. In the fixing section 9, the image transferred to the sheet is fixed by a heated heat roller 10 which is a fixing member, in which a heater (not shown) which is a heat generating body is stored, and by a pressing roller 11 which presses the sheet against the heat roller 10. The sheet is ejected from the apparatus after passing through a paper ejection section 12 and is stacked on a paper ejection tray.

Figure 6:
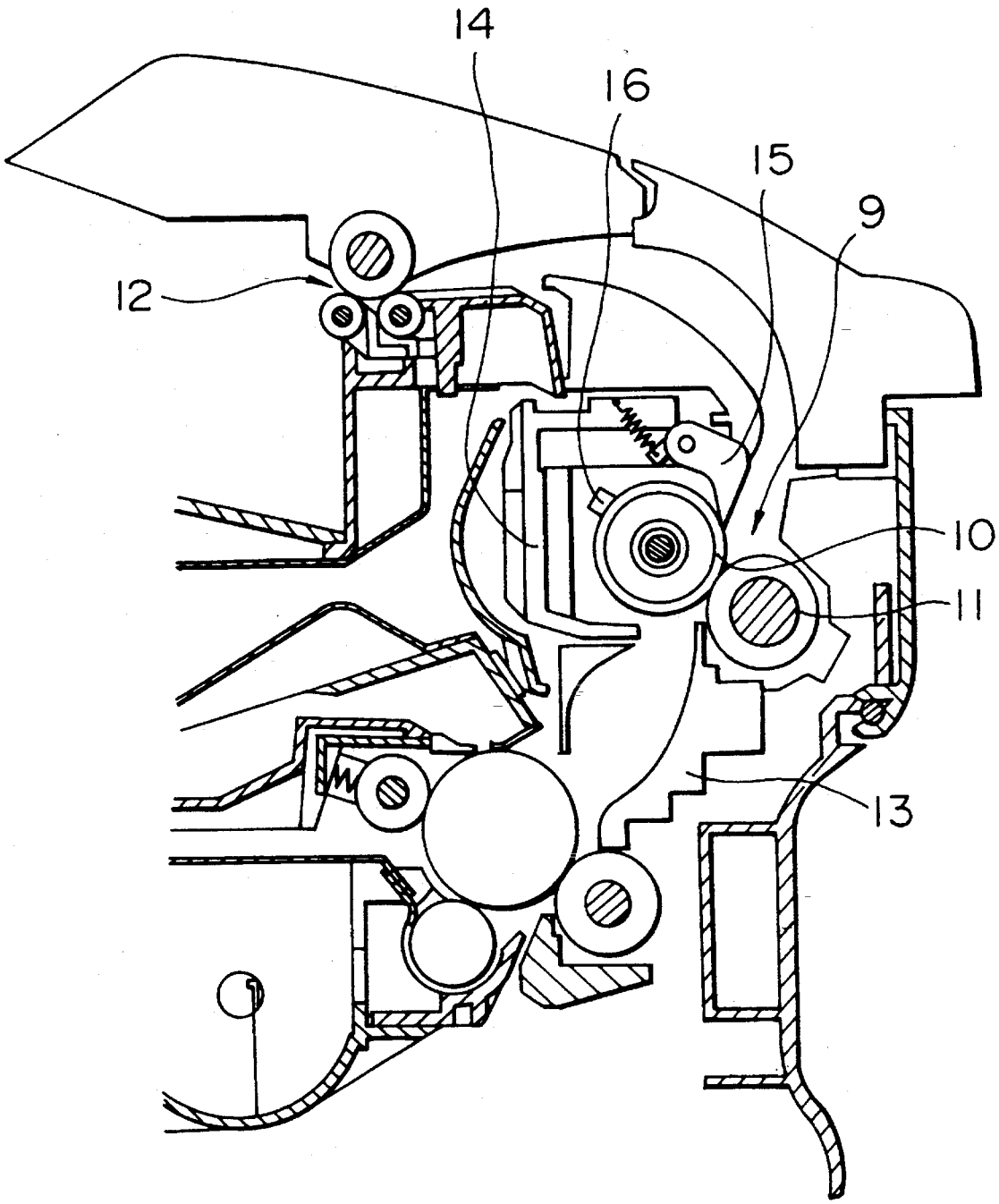
FIG. 6 is a cross-sectional view which illustrates the fixing section of the fixing apparatus of this embodiment.

FIG. 6 is a detailed illustration of the fixing section 9. In addition to the members described above, also disposed are a guide 13 for guiding a sheet to a contact portion between the heat roller 10 and the pressing roller 11, a sheathing 14, and a separation claw 15 for separating the sheet pressed against the heat roller 10 by the pressing roller 11 from the heat roller 10. Reference numeral 16 denotes a thermistor which is a temperature detection element for detecting the temperature of the surface of the heat roller 10, which thermistor is disposed in contact with the heat roller 10 at an end portion thereof outside the image area.

Figure 7:
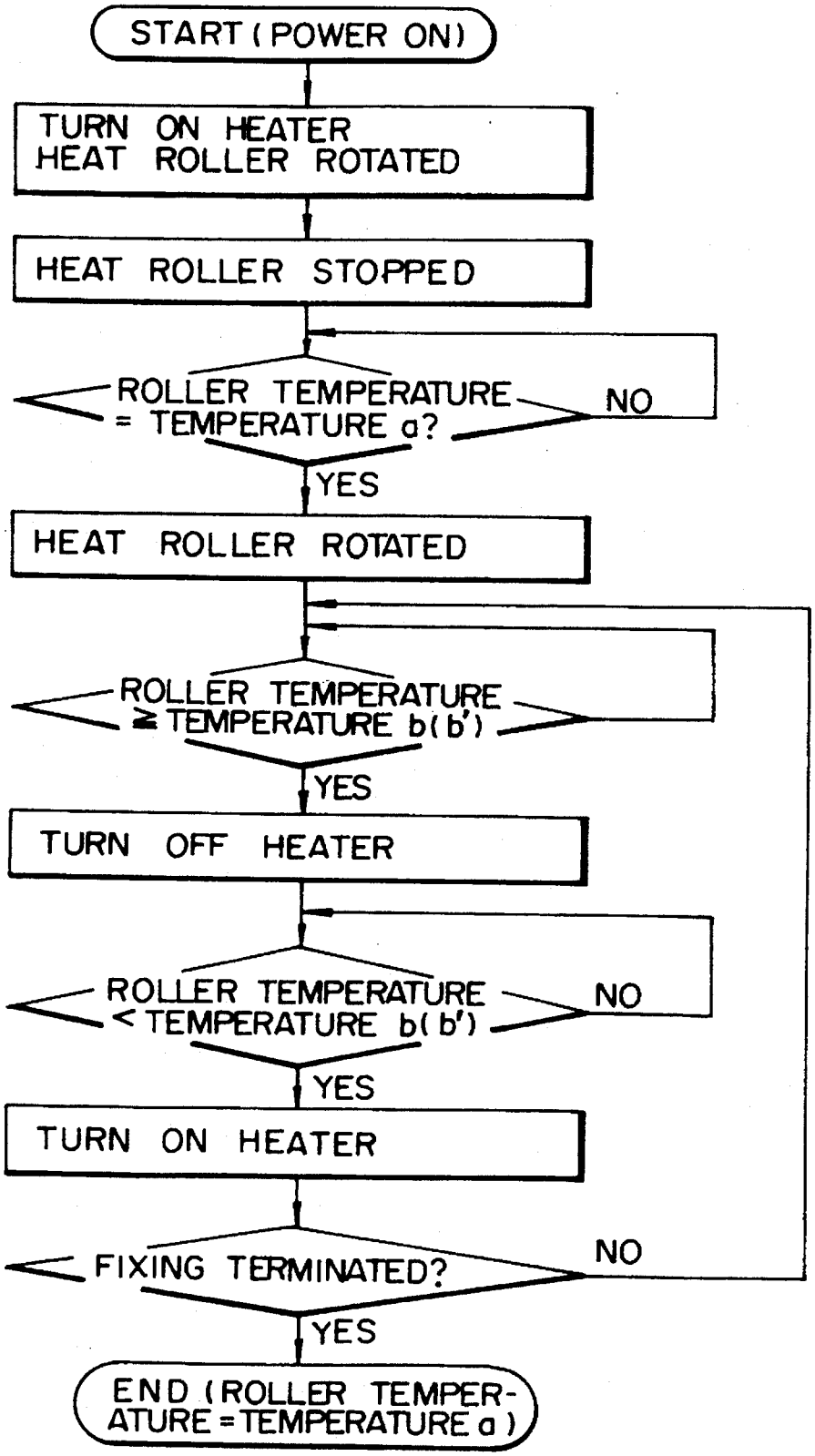
FIG. 7 is a simplified flowchart of the control of heating by a fixing member of the fixing apparatus shown in FIG. 5.
Figure 8:
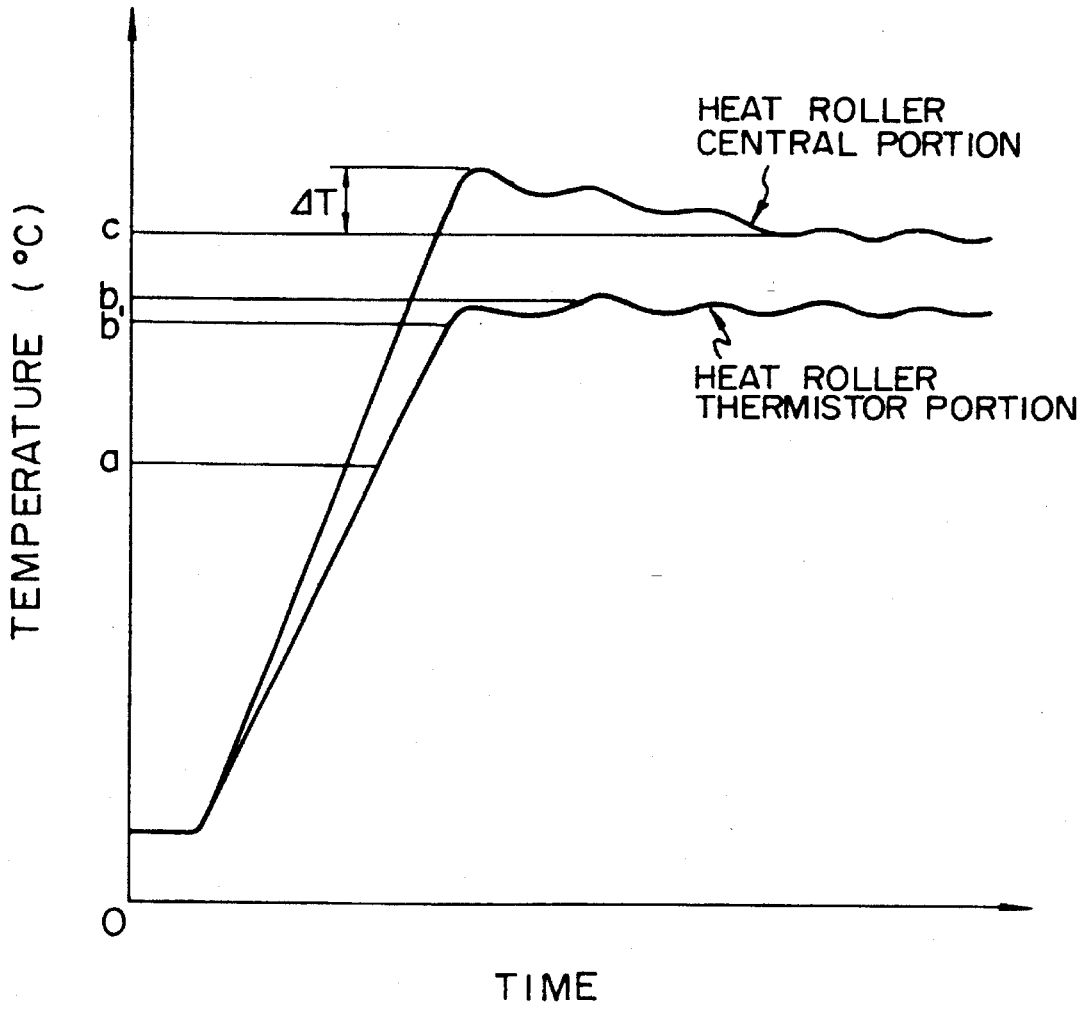
FIG. 8 is a graph which illustrates changes in the temperature of a heat roller.

FIG. 7 is a simplified flowchart of the control of heating by the heat roller 10. When the power supply of the fixing apparatus is turned on, the heat roller starts rotating and is rotated for a fixed time. A heater inside the heat roller 10, for example, a halogen lamp, is turned on and starts heating it. Although the heat roller 10 stops rotating thereafter, the heat roller 10 continues to be heated after rotation is stopped. When the temperature reaches a predetermined temperature a, the heat roller starts rotating again in order to make the temperature of the surface of the heat roller 10 uniform. When the temperature approaches a temperature b most appropriate for fixing, the control of turning on or off the heater intermittently in order to maintain temperature b is repeated. The transport of the sheet and fixing of the image are performed at a temperature near this temperature b. When the transport of the sheet and fixing of the image are completed and the apparatus enters a stand-by condition, the temperature of the heat roller 10 is decreased to and kept at temperature a. The control similar to that described above is performed starting at the temperature a during the fixing of an image on the next sheet.

Figure 1:
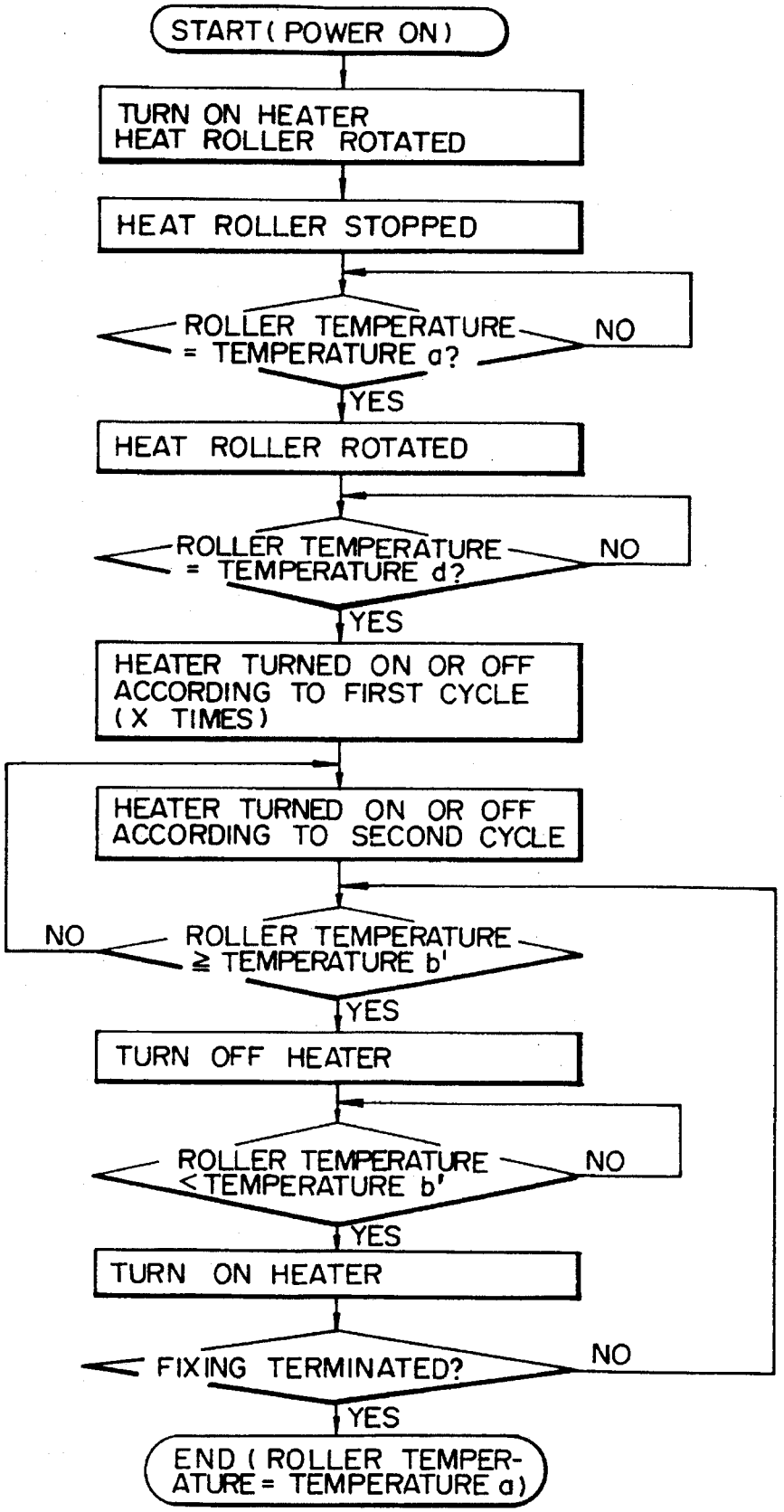
FIG. 1 is a flowchart of the control of heating by a fixing member of a fixing apparatus according to a first embodiment of the present invention.
Figure 2:
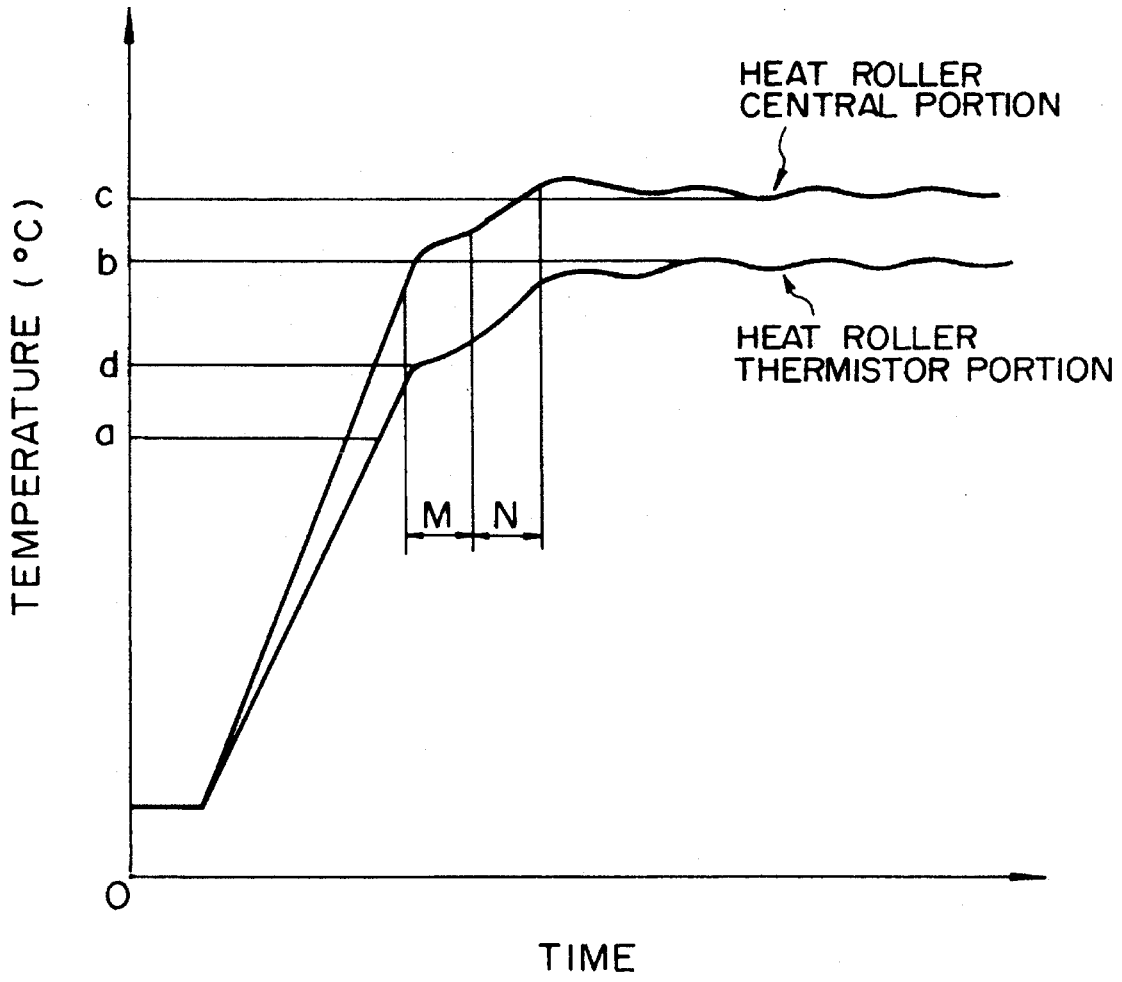
FIG. 2 is a graph which illustrates changes in the temperature of the fixing member at its central and thermistor portions according to the first embodiment of the present invention.

FIG. 1 is a flowchart which shows the control of heating in more detail according to the embodiment of the present invention. FIG. 2 is a view which illustrates changes in the temperature of the heat roller according to the embodiment of the present invention.

When the temperature of the heat roller 10 reaches temperature a, the heat roller starts rotating. Electric supply means supplies an electric current at a preliminary duty cycle until a predetermined temperature d is reached. When the roller temperature reaches a predetermined temperature d, the heater supplies electric current in an electric-supply pattern of a first duty cycle from the continuously turned-on state. After a predetermined number X of times of the electric supply at a first duty cycle in which there are on and off in any one cycle, an electric current is supplied at a second duty cycle.

Concerning the ratio of turned on to turned off, the ratio of turned on of the first electric supply pattern is smaller than that of the second electric supply pattern, and the ratio of turned off of the first electric supply pattern is larger than that of the second electric supply pattern. That is, the second duty cycle is larger than the first duty cycle. In this embodiment, the first duty cycle is set at 30%, and the second duty ratio is set at 60%. The electric current supply is controlled on or off so that the output of the thermistor becomes constant when the temperature approaches the fixing temperature b. The graph of the temperature of the heat roller is as shown in FIG. 2 according to this control method. The temperature gradient is lessened when the temperature d is exceeded. After turning-on or -off is performed at the first duty cycle for time M, turning-on or -off is performed at the second duty cycle for time N, and control is switched to one in which the temperature is maintained at the temperature b. Since the turned-on time at the second duty cycle is longer than that at the first cycle, the gradient of temperature is slightly sharper.

Figure 3:
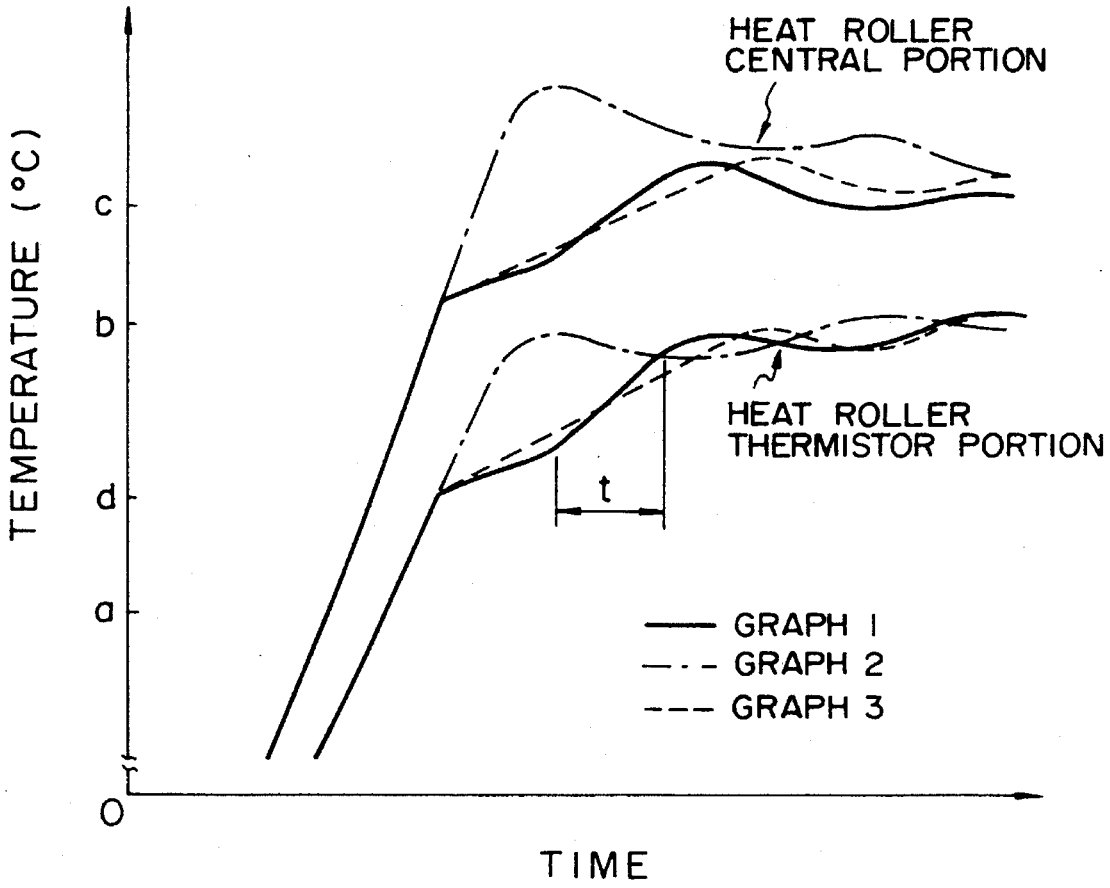
FIG. 3 is a graph illustrating the difference between the apparatus according to the first embodiment of the present invention and a comparative example.

Differences between this embodiment and an comparative example are shown in FIG. 3.

In FIG. 3, graph 1 shows changes in the temperature effected by the control of this embodiment; graph 2 shows changes in the temperature effected by continuous turned-on control; and graph 3 shows changes in the temperature effected by the control in which turning-on or -off is performed intermittently. As is clear from this figure, the overshoot amount $\Delta T$ according to the control of this embodiment is smaller than that of the continuously turned-on control in graph 2, and the temperature b is reached earlier than in the case of the intermittent control at a constant ratio in graph 3. The reason why the temperature b is reached earlier is because the turned-on time becomes longer when it switches to the second duty cycle and the gradient of the temperature sharpens. The temperature b can be reached before the inertia of the temperature increase becomes large because time t from the switching until the temperature b is reached is short. As a result, the overshoot amount can be decreased.

Although in the above-described embodiment the duty cycle is switched two times, it may be switched more times.

Next, a second embodiment of the present invention will be explained with reference to FIG. 4 and Table 1. Parts which are the same as in the first embodiment are given the same reference numerals, and the explanation thereof is omitted.

Table 1 is a table showing the duty cycle of switching between turned-on and turned-off conditions. FIG. 4 is a flowchart of the control for heating a heat roller.

In this embodiment, after turning-on and -off are repeated at the first ratio from temperature a to temperature b, the turning-on and -off are performed at the second duty cycle. The above operation is the same as in the first embodiment. A point of difference between the first and second embodiments is that these two duty cycles are determined from the ambient temperature by detecting the ambient temperature of an image forming apparatus. That is, there are provided a detecting means formed of a sensor for detecting the ambient temperature, and a means for selecting and determining the ratio of turned on to turned-off according to the detected ambient temperature.

As shown in Table 1, regarding the selection of the ratio of turned-on to turned-off time, the ambient temperature T' is divided into three segments from low to high and the selection is made in a set of the first and second duty cycles.

TABLE 1

| Ambient temperature | Ratio of turned-on to turned-off: Turned-on | Ratio of turned-on to turned-off: Turned-off | Ratio of turned-on to turned-off: Turned-on | Ratio of turned-on to turned-off: Turned-off |
|---|---|---|---|---|
| T' < T1 | m1 | n1 | m1' | n1' |
| T1 ≦ T' < T2 | m2 | n2 | m2' | n2' |
| T' ≧ T2 | m3 | n3 | m3' | n3' |

In the above table, $m_1<m_1'$, $m_2<m_2'$, $m_3<m_3'$, $m_1>m_2>m_3$, and $m_1'>m_2'>m_3'$. When T' is less than T1, the first duty cycle is m1/n1 and the second duty cycle is m1'/n1'/n1'. When T' is between T1 and T2, the first duty cycle is m2/n2 and the second duty cycle is m2'/n2'. When T' is greater than or equal to T2, the first duty cycle is m3/n3 and the second duty cycle is m3'/n3'.

Figure 4:
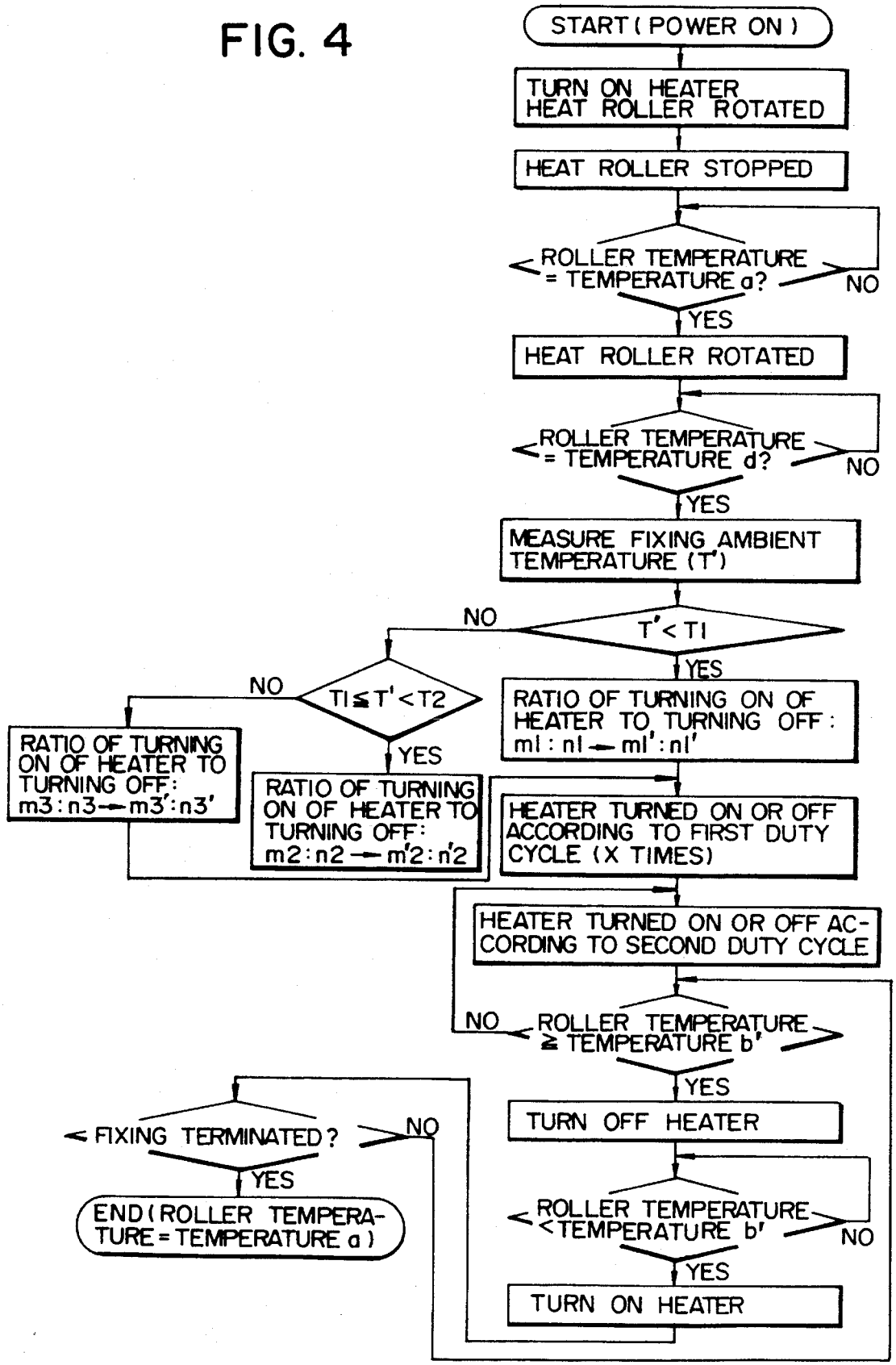
FIG. 4 is a flowchart of the control of heating by a fixing member of a fixing apparatus according to a second embodiment of the present invention.

In the heating control, as shown in FIG. 4, after the temperature d is reached, the ambient temperature T' is detected. The duty cycle is selected depending upon the value of T. An electric current is supplied at the selected duty cycle. The first and second duty cycles need not both be changed according to the ambient temperature: only one of them need be changed.

According to this embodiment, because a means for reflecting the ambient temperature detected in the temperature control of the heat roller is provided, optimum temperature control can always be performed for the ambient temperature. As a result, the time required to reach the temperature b can be suppressed while at the same time the overshoot amount ΔT can be suppressed to a small value more stably than in the first embodiment.

Although in the above-described embodiment the ratio of turned-on to turned-off time is selected and determined, a method may be used in which the ratio of turned-on to turned-off time is constant and the number of times turning-on and -off are performed at the time of switching from the first duty cycle to the second duty cycle, that is, at the first cycle, may be selected and determined.

Needless to say, if the ambient temperature T' is divided into more than three segment is in this embodiment, accounting for the ambient temperature is even more precise.

Many different embodiments of the present invention may be constructed without departing from the spirit and scope of the present invention. It should be understood that the present invention is not limited to the specific embodiments described in this specification. To the contrary, the present invention is intended to cower various modifications and equivalent arrangements included with the spirit and scope of the claims.

What is claimed is:

1. A fixing apparatus, comprising:

a heating member maintained at a predetermined fixing temperature;

electric supply means for supplying an electric current to the heating member; and control means for controlling a duty cycle of the electric current, wherein said control means decreases said duty cycle and then increases it after the electric-current supply to said heating member is started but before said heating member has reached at said predetermined fixing temperature.

2. A fixing apparatus according to claim 1, wherein said control means switches a preliminary duty cycle to a first duty cycle being smaller than said preliminary duty cycle, and said first duty cycle to a second duty cycle being larger than said first duty cycle but smaller than said preliminary duty cycle.

3. A fixing apparatus according to claim 2, wherein said preliminary duty cycle is 100%.

4. A fixing apparatus according to claim 1, wherein said control means decreases said duty cycle at the time when said heating member reaches a predetermined temperature being lower than said fixing temperature.

5. A fixing apparatus according to claim 1, wherein said control means increases said duty cycle when a predetermined length of time of electric current supply at the decreased duty cycle is reached.

6. A fixing apparatus according to claim 1, wherein said control means increases said duty cycle at a time when said heating member reaches a predetermined temperature which is lower than said fixing temperature.

7. A fixing apparatus according to claim 1, further comprising means for adjusting the duty cycle in accordance with a ambient temperature.

* * * * *

UNITED STATES PATENT AND TRADEMARK OFFICE

CERTIFICATE OF CORRECTION

PATENT NO. : 5,465,141

DATED : November 7, 1995

INVENTOR(S) : NAOKI ASANO, et al.

It is certified that error appears in the above-indentified patent and that said Letters Patent is hereby corrected as shown below:

COLUMN 2

Line 25, "Will" should read --will--.

COLUMN 3

Line 10, "irrespectively" should read --respectively--.

COLUMN 4

Line 64, "turned on" should read --turned-on--.

COLUMN 5

Line 18, "m2/n2" should read --$m2^1/n2$--.
Line 19, "$m2^1/n2^1$." should read --m2/n2.--.
Line 25, "ofT." should read --of T.--.
Line 46, "segment is" should read --segments--.

UNITED STATES PATENT AND TRADEMARK OFFICE

CERTIFICATE OF CORRECTION

PATENT NO. : 5,465,141 Page 2 of 2

DATED : November 7, 1995

INVENTOR(S) : NAOKI ASANO, et al.

It is certified that error appears in the above-indentified patent and that said Letters Patent is hereby corrected as shown below:

COLUMN 6

Line 7, "cower" should read --cover--.
Line 45, "a" should read --an--.

Signed and Sealed this

Twenty-sixth Day of March, 1996

Bruce Lehman

*Attest:*

BRUCE LEHMAN

*Attesting Officer*

*Commissioner of Patents and Trademarks*